US009279645B2

(12) United States Patent
Schlenter et al.

(10) Patent No.: US 9,279,645 B2
(45) Date of Patent: Mar. 8, 2016

(54) ELECTRONIC DETONATOR

(71) Applicant: DETNET SOUTH AFRICA (PTY) LTD, Sandton (ZA)

(72) Inventors: Craig Charles Schlenter, Sandton (ZA); Herman Van Der Walt, Sandton (ZA)

(73) Assignee: DETNET SOUTH AFRICA (PTY) LTD, Sandton (ZA)

( * ) Notice: Subject to any disclaimer, the term of this patent is extended or adjusted under 35 U.S.C. 154(b) by 0 days.

(21) Appl. No.: 14/381,970

(22) PCT Filed: Jan. 9, 2013

(86) PCT No.: PCT/ZA2013/000001

§ 371 (c)(1),
(2) Date: Aug. 28, 2014

(87) PCT Pub. No.: WO2013/131110

PCT Pub. Date: Sep. 6, 2013

(65) Prior Publication Data

US 2015/0013560 A1 Jan. 15, 2015

(30) Foreign Application Priority Data

Feb. 29, 2012 (ZA) ..... 2012/01488

(51) Int. Cl.

| | |
|---|---|
| ***F42B 3/10*** | (2006.01) |
| ***F42B 3/12*** | (2006.01) |
| ***F42C 11/00*** | (2006.01) |
| ***F42C 11/04*** | (2006.01) |

(52) U.S. Cl.

CPC . *F42B 3/10* (2013.01); *F42B 3/122* (2013.01); *F42C 11/008* (2013.01); *F42C 11/04* (2013.01)

(58) Field of Classification Search

CPC ..... F42B 3/10; F42B 3/122; F42C 11/008; F42C 11/04; F42C 13/08

USPC ..... 102/202.14, 209, 212

See application file for complete search history.

(56) References Cited

U.S. PATENT DOCUMENTS

| | | | | |
|---|---|---|---|---|
| 2,977,881 | A * | 4/1961 | Piper | 102/209 |
| 3,119,335 | A * | 1/1964 | Wyser | 102/209 |
| 3,120,187 | A * | 2/1964 | Wyser | 102/209 |
| 3,636,390 | A | 1/1972 | Stauder et al. | |

(Continued)

FOREIGN PATENT DOCUMENTS

| | | |
|---|---|---|
| CA | 2804695 | 1/2012 |
| CA | 2844758 | 3/2013 |
| CA | 2844836 | 3/2013 |

OTHER PUBLICATIONS

International Search Report for PCT/ZA2013/000001 dated May 23, 2013 (3 pages).

(Continued)

*Primary Examiner* — Bret Hayes

(74) *Attorney, Agent, or Firm* — Michael Best & Friedrich LLP

(57) ABSTRACT

An electronic detonator (10) which includes a housing (12) which contains an explosive charge (18), an initiating element (20), a control circuit (24), at least one coil (32) having a plurality of windings (30) in a tubular configuration, and a magnet (40) wherein passage of the magnet (40) through the coil (32) creates voltage to which the control circuit (24) is responsive, and a connector (46) for connecting a shock tube (48) to the housing (12).

9 Claims, 3 Drawing Sheets

(56) References Cited

U.S. PATENT DOCUMENTS

| | | | | | |
|---|---|---|---|---|---|
| 3,981,245 | A | * | 9/1976 | Buzzell et al. | 102/209 |
| 4,005,658 | A | * | 2/1977 | Karayannis | 102/209 |
| 4,296,688 | A | * | 10/1981 | Orlandi | 102/218 |
| 4,417,518 | A | * | 11/1983 | Siebert et al. | 102/212 |
| 4,637,311 | A | * | 1/1987 | Rehmann | 102/209 |
| 5,889,228 | A | | 3/1999 | Ewick et al. | |
| 2008/0115686 | A1 | | 5/2008 | Crist et al. | |
| 2011/0155012 | A1 | | 6/2011 | Perez Cordova et al. | |
| 2012/0012019 | A1 | | 1/2012 | Harding et al. | |
| 2012/0111216 | A1 | | 5/2012 | Koekemoer et al. | |

OTHER PUBLICATIONS

Written Opinion for PCT/ZA2013/000001 dated May 23, 2013 (6 pages).

International Preliminary Report on Patentability for PCT/ZA2013/000001 dated Feb. 25, 2014 (9 pages).

* cited by examiner

ELECTRONIC DETONATOR

BACKGROUND OF THE INVENTION

This invention relates to an electronic detonator.

An electronic detonator typically includes a timer which is capable of executing a time delay with a degree of accuracy which is not attainable with a pyrotechnic device. This allows for improved blasting and fragmentation of rock.

Various techniques exist for initiating an electronic detonator. In one approach an end of a shock tube is exposed to one or more sensors which are included in a detonator. These sensors, in response to a genuine shock tube event, commence a process for initiating the detonator. A benefit which is associated with the use of a shock tube to initiate a detonator, is that some of the problems associated with traditional wired electronic blasting systems, such as wire breakage or current leakage in harsh environments, are obviated.

One kind of shock tube-initiated, electronic detonator employs a piezoelectric element which, in response to a pressure wave produced upon ignition of a shock tube, generates electrical energy. In a different approach, used for example in a detonator known as the ISKRA-T, electrical energy is produced by a magnetic pulse generator which is operated in response to a pressure wave from a shock tube event.

Although the aforementioned detonators do away with the need for interconnecting conductive wires, their usage is limited in one respect namely that each detonator is programmed under factory conditions with a predetermined delay time. This means that a blasting practitioner must keep in stock a number of different detonators with different time delays to cater for common blasting requirements.

Another drawback which is linked to a detonator which makes use of a magnetic generator is that the quantity of electrical energy which is produced by the generator may be limited and this would restrict the duration of the time delay interval to about 3 seconds (in the case of the ISKRA-T).

South African patent application No. 2010/04911 proposes a shock tube-initiated, electronic detonator system in which delay times are programmable in the field. South African patent application No. 2011/06918 describes the use of a radio frequency identity tag in which RFID techniques are used for communicating with an electronic detonator. The use of an optical communication path to a detonator is described in South African patent application No. 2011/06962. Another approach, disclosed in the specification of South African patent application No. 2009/06891, is to cause a battery to be moved inside a detonator, in response to a shock tube output, to initiate a timer.

A detonator which has an on-board battery, as a power source, inherently has a limited shelf life. The battery does, however, allow for an accurate determination of a relatively long time delay. By way of contrast magnetically and piezo-powered detonators do not have a battery-imposed shelf life limitation but, as noted, are not normally capable of executing a long time delay.

An article entitled "Modelling, Design and Testing of an Electromagnetic Power Generator Optimized for Integration into Shoes" describes an optimised design for a magnetic generator for harvesting power produced during walking. The document is silent on the use of the techniques disclosed therein in a detonator application.

An object of the present invention is to provide an electronic detonator which, at least to some extent in a preferred embodiment, addresses the aforementioned factors.

SUMMARY OF THE INVENTION

The invention provides an electronic detonator which includes a housing and, located within the housing, an explosive charge, an initiating element which is exposed to the explosive charge, a control circuit, at least one coil which includes a plurality of windings in a tubular configuration, with a first end, an opposed second end and a hollow interior between the first and second ends, the control circuit being responsive to a voltage produced in the coil, a magnet which is held at a rest position which is displaced from the coil, wherein a passage, through which the magnet can move, is formed from the rest position to the first end of the coil, through the hollow interior to a second end of the coil and then to a remote position, and a connector for connecting a shock tube to the housing with an end of the shock tube opposing the magnet at the rest position.

A retention mechanism may be employed for retaining the magnet at the rest position. The retention mechanism may take on any suitable form and in one embodiment of the invention includes a frangible membrane which holds the magnet in place. In a different form of the invention the magnet is magnetically adhered to a magnetisable material, e.g. a ferromagnetic material located at the rest position.

In another form of the invention the magnet is adhered to suitable structure thereby to retain the magnet in the rest position. Preferably the nature of the adhesive is such that the adhesive is combustible and, upon combustion of the adhesive, an adhesive force which is exhibited by the adhesive is reduced to zero thereby allowing the magnet to move freely along the aforementioned passage. Preferably combustion of the adhesive results in the release of energy which is additional to that produced by a shock tube event. The net effect of the energy produced by combustion of the adhesive and the energy produced by the shock tube event helps to propel the magnet at a high speed through the passage. It is observed in this respect that the quantity of electrical energy produced due to this type of action, is dependent on the speed of movement of the magnet relative to the coil for this determines the rate at which magnetic flux linkages are broken.

Use may be made of one or more seals to seal a gap or interface between a surface of the magnet and an opposing surface of the passage.

A lubricant may be provided on a surface of the passage to ensure that movement of the magnet along the passage takes place without undue frictional drag.

At the remote position a rebound mechanism may be positioned. This may be a biasing or energy-absorbing device such as a spring or a resilient material which absorbs kinetic energy from an impacting magnet and which then releases energy by causing the impacting magnet to move in an opposing direction. The magnet is thereby moved in a reverse direction through the passage and, in particular, through the hollow interior of the tubular coil. In the process further electrical energy is generated in the coil.

The detonator may include one or more sensors to detect one or more characteristics which are uniquely associated with a genuine shock tube event i.e. detonation of the shock tube. The type of sensor employed can vary according to requirement. For example heat or temperature effects produced by a genuine shock tube event can be monitored by appropriate sensors and information thereon can be directed by the sensor or sensors to the control circuit.

In one form of the invention at least one link is exposed to an end of the shock tube and the integrity of the link is monitored by means of the control circuit. If the link is broken, for example by the application of a force in excess of a predetermined minimum, then the link is open-circuited, from an electrical point of view, and this can be detected by the control circuit. To enhance the safety of operation of the detonator use is preferably made of two or more links each of which is exposed to the effect of a shock tube event. Each link is required to respond to the shock tube event in a predetermined way (typically to be broken) within a prescribed time period.

Clearly it is practically difficult to measure if a link is broken within a prescribed period in the absence of power. The breaking of a link at a far end of the coil may however be detectable for, by that time, there may be sufficient power available to cause the measurement circuitry to function properly.

It is possible to include within the detonator, e.g. in a chamber or on a surface exposed to the end of the shock tube, a fluorescent material which is activated by light or other energy produced by the shock tube event. Light which is directly produced by the shock tube event can be sensed as well as secondary light i.e. that produced by fluorescence or some other mechanism which, optionally, could be of a longer duration than the light which is produced by the shock tube event.

The use of one or more sensors of a different kind e.g. responsive to temperature, in combination with one or more links, is also intended to fall within the scope of the invention. A prerequisite in this respect is that, as the detonator does not include an on-board power source (typically a battery), the characteristic which is to be sensed must persist or be discernible for a relatively long time period so that it can still be detected when electrical energy produced by movement of the magnet through the coil is available to power the control circuit. It is for this reason that the use of a frangible link is desirable. Additionally though, as indicated, a rise in temperature which is attributable to a shock tube event and which persists until such time as the magnet generates electrical energy which can be used to monitor the temperature rise, may also be employed.

When the control circuit detects electrical energy in the coil, the control circuit only associates movement of the magnet with a genuine shock tube event provided, additionally, that the sensor or sensors referred to, identify characteristics which are uniquely associated with a genuine shock tube event, at the same time or within a predetermined time period.

The control circuit may include a communication module which is adapted to process a communication signal received by the coil, and to use the coil as a transmitting coil (antenna) for the transmission of data. The term "transmission of data" encompasses direct transmission of data by means of a transmitting coil and the transmission of data using techniques associated with, for example, an RFID tag. In the latter case a receiving coil is not energised in order to transmit to a control device. Instead the receiving coil or antenna is "detuned" by selectively shorting its terminals. This produces a change in the load experienced in a transmitting coil in control equipment. The change in load is detectable by the control equipment. The nature and extent of the change can be used for the transferring of data to the control equipment. This type of communication may be effected using magnetic communication techniques of the kind described in the specification of South African patent application No. 2011/06918 the content of which is hereby incorporated into this specification.

The electrical energy which is required to power the control circuit to enable communication signals to be received and to be sent may be transmitted at a relatively low frequency, preferably less than 1 MHz, to restrict eddy current losses in the housing which typically is made from metal (aluminium or copper).

As the quantum of electrical energy produced by movement of the magnet is not high it is necessary for effective operation that the relevant parameters of the magnetic generator should be optimised so that maximum power can be produced by the generator. Various factors can influence the quantum of electrical energy produced by the generator. Without being limiting these include the following:

a) the duration and magnitude of the pressure pulse produced by the shock tube and by any additional device (if included) used to enhance the shock effect;
b) the initial spacing of the magnet from the coil. Ideally the magnet should be at a maximum speed when it enters the coil. In general terms it is noted that the magnet will continue accelerating provided the force which is exerted by the pressure pulse exceeds resistance forces in the form of air pressure, friction and so on;
c) the cross-sectional area of the magnet must be optimised taking into account the cross-sectional area of the coil windings;
d) the number of windings (turns) on the coil, and the diameter of the wire used for the windings. It is counterproductive to increase the number of turns to a point at which the resistance of the wire adversely affects the quantum of power which is developed. The resistance of the coil will also contribute to an RC time delay when charging of a storage capacitor occurs;
e) the length of the coil should be roughly the same as the length of the magnet. For example if the coil is long and the magnet is relatively short then substantially no power is generated while the magnet's field is fully enclosed by the coil for there is no change in the product of flux density and the number of windings;
f) multiple coils may be connected to one another in series. The coils should however be sufficiently far apart so that they are magnetically independent of each other with respect to the field generated by the magnet. This aspect can be addressed by separately rectifying the output of each coil and connecting the output to a bridge/capacitor circuit. The rectified outputs can be connected in series and the coils can be placed next to one another;
g) it is possible to make use of an active bridge, which employs an active device such as a field effect transistor, connected to output terminals of a coil, to obtain a lower voltage drop and thus decrease losses;
h) the magnet should have maximum magnetic strength. To this end use may be made of a rare earth magnet;
i) the magnet's size-to-weight ratio should be as small as possible so that it can be accelerated to a maximum extent in order to optimise the voltage produced in the coil;
j) multiple magnets, spaced from each other, may be employed. It is noted in this respect that as the number of magnets is increased the overall mass thereof also increases and this implies that the speed of the magnets through the coil or coils will be lower. If this route is adopted therefore a compromise must be struck between increasing the moving magnetic field density and the associated reduction in magnet speed.

Similarly efficient energy consumption techniques should be adopted within the control circuit. For example sleep cycling techniques which allow longer delay times to be achieved may be embodied in the control circuit. These techniques in general terms imply that a device is placed in a low power mode by turning off unused circuitry until some event occurs, e.g. such as a timer triggering.

As the coil is used for the generation of electrical energy (to power the control circuit, to execute the timing interval and to initiate or fire the detonator) and for communication purposes (e.g. to validate operational aspects of the detonator), it is necessary to distinguish a signal which is produced within the coil by the moving magnet from a communication signal. Apart from using the sensors referred to, the magnet, when held at the rest position, may bridge contacts and effectively close a circuit. When the magnet moves away from the contacts the circuit is open-circuited. This is equivalent to the use of a link which is positioned so that it is broken by a pressure wave produced by a genuine shock tube event. The switching of the circuit can be used as an indicator to distinguish the two types of signals.

BRIEF DESCRIPTION OF THE DRAWINGS

The invention is further described by way of example with reference to the accompanying drawings in which.

DESCRIPTION OF PREFERRED EMBODIMENT

Figure 1:
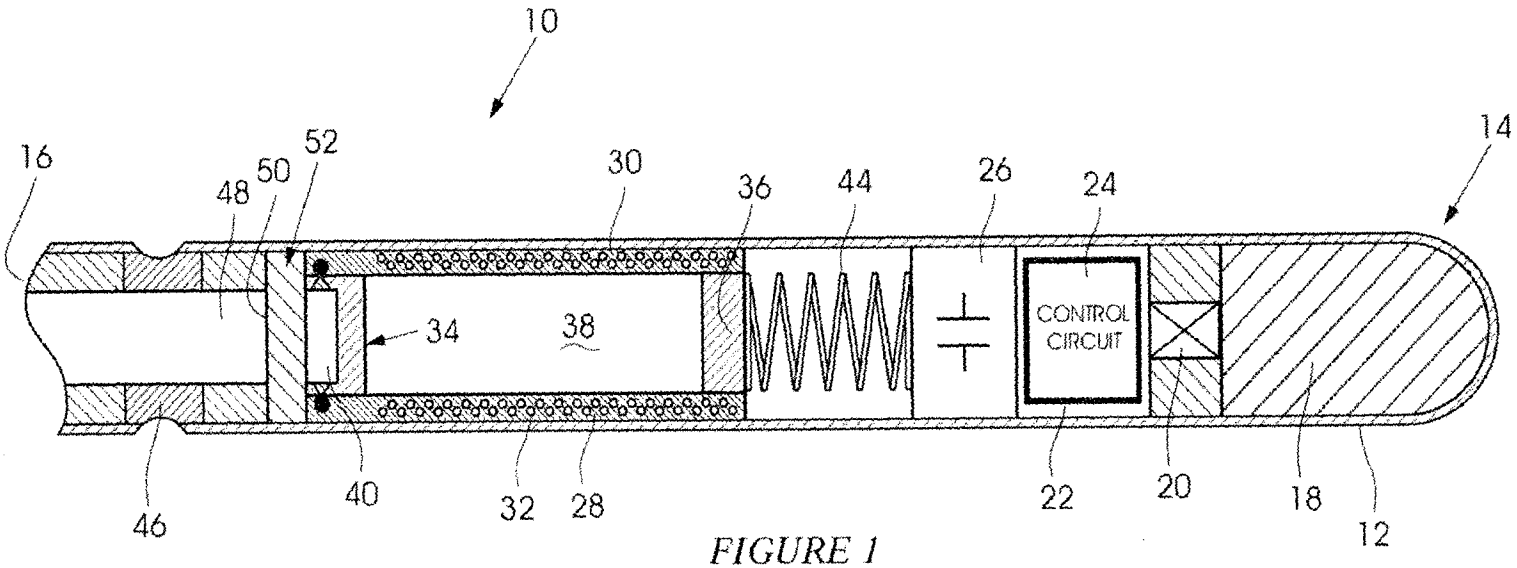
FIG. 1 is a side view in section of an electronic detonator according to one form of the invention.

FIG. 1 of the accompanying drawings illustrates in cross-section and from one side an electronic detonator 10 according to the invention. The detonator includes a metallic tubular housing 12 made for example from aluminium or copper which has a blind end 14 and a mouth 16. An explosive charge 18 of a kind known in the art is loaded into the tubular housing and is exposed to an initiating element 20 which is carried on a printed circuit board 22. This board carries a control unit or processor 24 and includes an energy storage arrangement 26 comprising, for example one or more capacitors. The construction of the detonator described thus far is largely conventional and for this reason is not elaborated on.

A tube 28 is positioned in the housing 12 fairly close to the mouth 16. The tube is made from a suitable insulating material and, embedded in the tube, are a plurality of windings 30 which constitute an elongate coil 32. The coil 32 has a first end 34, a second remote end 36 and, within the tube, a hollow interior 38, of circular cross-section is formed. Output terminals of the coil are connected via a bridge circuit to the storage capacitor or capacitors 26.

A permanent magnet 40 is positioned at the first end 34—this is referred to herein as a "rest position" for the magnet. At the second end 36 an energy accumulator or biasing device 44 is positioned. This is in the nature of a flexible resilient material, a spring or the like. An intention in this respect is that the device 44 should be capable of absorbing and storing kinetic energy and of then releasing the stored energy as it expands or reverts to its original shape and size.

A plug 46 is engaged with a shock tube 48 and is crimped to the tubular housing 12. An end 50 of the shock tube is exposed to a composition 52 which is used to adhere the magnet, within the housing, at the rest position. Optionally the composition 52 is an energetic material so that, when exposed to a shock wave which is produced at the end 50 when the shock tube is ignited, it is also ignited and thereupon emits energetic material at a relatively high pressure which exerts force on the magnet 40.

Figure 2:
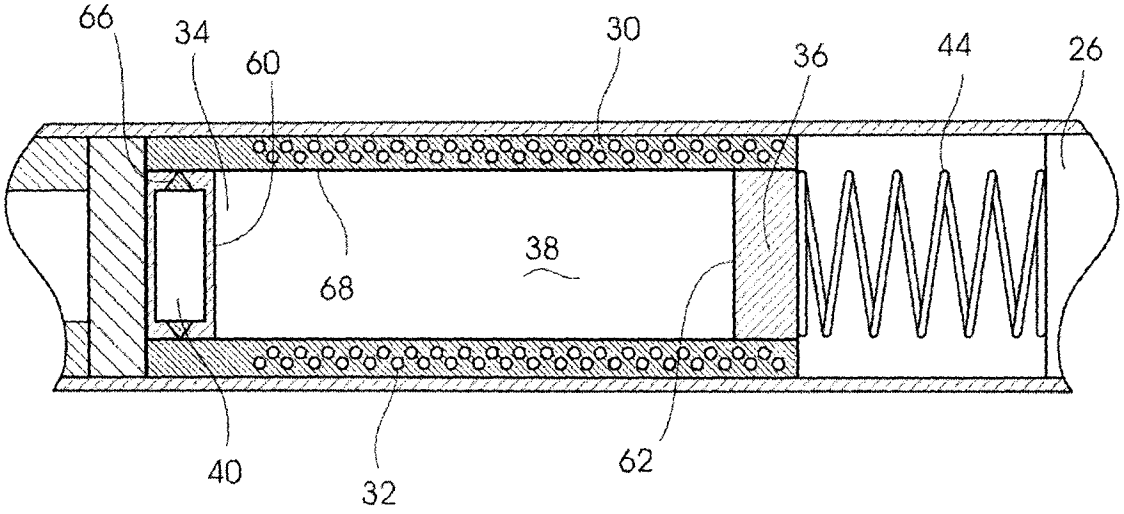
FIG. 2 is a side view in section and on an enlarged scale of part of the detonator shown in FIG. 1.

FIG. 2 shows the tube 30 on an enlarged scale. Positioned inside the tube are two thin wires or links 60 and 62 respectively which are close to the first and second ends 34 and 36 and which traverse the hollow interior 38. The magnet 40 has a circular cross-sectional shape with a diameter which is slightly less than the diameter of the hollow interior 38. A small seal 66 is fixed to a periphery of the magnet and extends circumferentially around the magnet abutting an inner wall 68 of the tube 30 effectively in a gas tight manner.

The control circuit 24 (FIG. 1) includes a communication module for communicating with a programming or testing machine using electromagnetic principles for example of the kind described in the specification of South African patent application No. 2011/06918. In essence a communication signal detected by the coil 32 provides energy for operation of the control circuit during a communication phase and also transfers commands or data to the control circuit. These commands and data are processed in a predetermined manner by the control circuit and, in response thereto, a confirmatory or other signal is transmitted from the control circuit to the programming or testing machine using the coil 32 as a transmitting antenna.

The coil 32, in one mode of operation, forms part of a magnetic generator which produces electrical energy which is stored in the capacitors 26. This energy is used to power the circuit prior to a blasting event taking place and, in particular, is used to ensure an accurate execution of an extended timing interval by means of a timing device incorporated in the control circuit 24, and to provide energy to the initiating element 20 for firing the charge 18.

Assume that the shock tube 48 is ignited and propagates a shock front (pressure wave) to the composition 52. Energetic material is released by the shock tube and ignites the composition 52.

The magnet is thus subjected to the combined effect of a first pressure wave, produced by the shock tube, and a second pressure wave which is produced upon combustion of the composition 52. The force exerted on the magnet by the two pressure waves rapidly propels the magnet from the rest position through the hollow interior 38 and, at the end 36, the magnet impacts the biasing device 44.

At this end kinetic energy embodied in the moving magnet is absorbed by the biasing device which thereafter is capable of releasing a substantial part of this energy thereby causing the magnet to travel in the reverse direction along the hollow interior i.e. from the second end 36 towards the first end 34.

Movement of the magnet through the coil 32 produces electrical energy, in accordance with known principles, which is stored in the capacitors 26. Secondly, the links 60 and 62 are broken by a physical force which is exerted on the links by the magnet as it impacts against these links.

Figure 3:
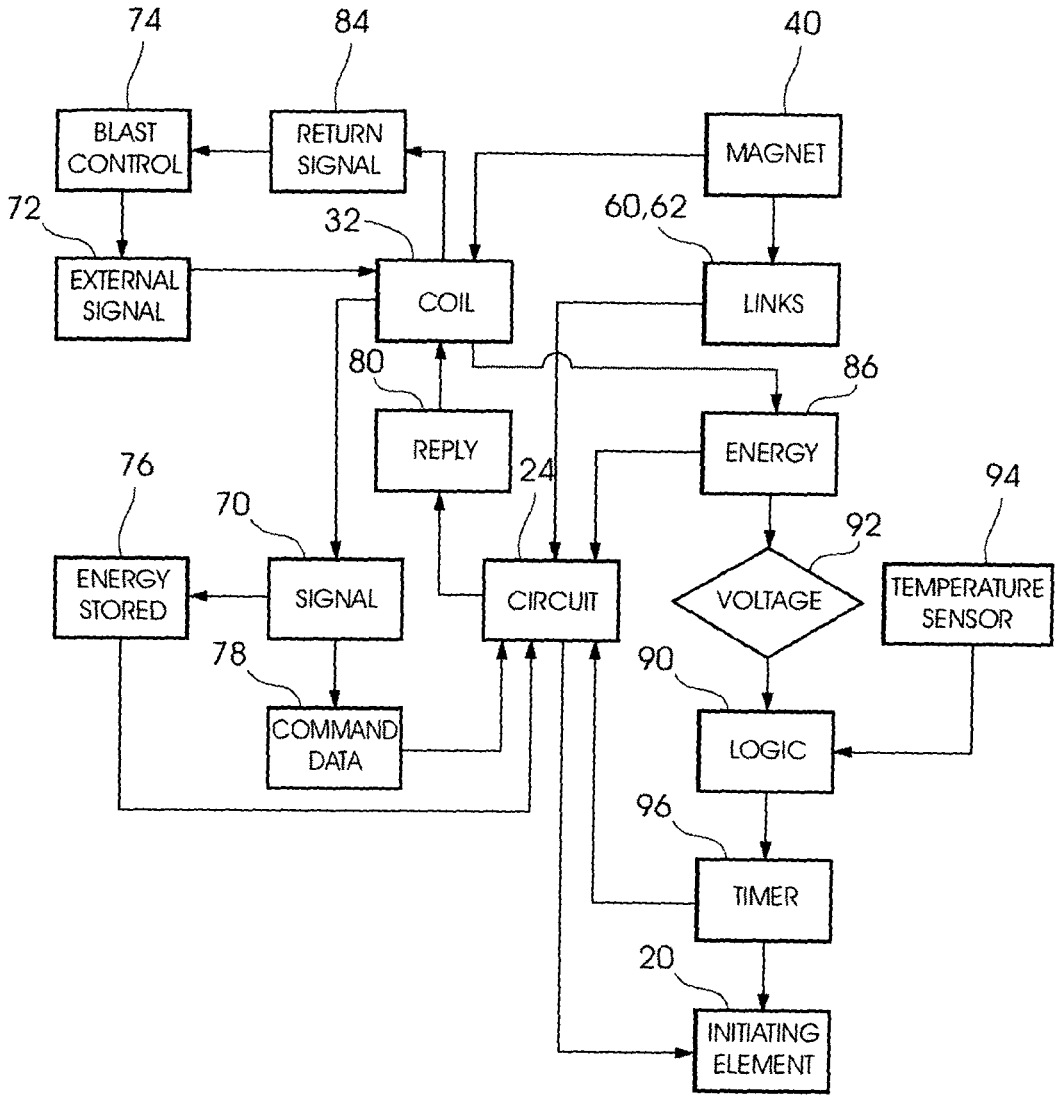
FIG. 3 is a simplified block diagram representation of certain processes carried out during the operation of the detonator of the invention.

FIG. 3 illustrates in block diagram form aspects of the aforementioned process. During a communication phase the coil 32 generates an electrical output signal 70 in response to a communication signal 72 transmitted, say, by a centralised control device or programming or testing machine 74.

Some of the electrical energy 76, contained in the signal 70, is extracted, stored and used to power part of the circuit 24. The signal 70 additionally contains data or commands 78 used, for example, to set parameters within the control circuit 24 or to validate aspects of its operational status.

Once the circuit 24 has processed the commands or data a reply signal 80 is produced by the control circuit which uses the coil 32 as a transmitting antenna, to transmit at radio frequency a return signal 84 to the programming testing machine.

A shock tube event is regarded as a precursor to initiation of the detonator. When a shock tube event occurs, as has been described, the magnet, in moving through the hollow interior 38, produces electrical energy 86 which is stored in the capacitors 26. The circuit 24 is powered by this energy. As noted it is essential to ensure that the circuit 24 is capable of distinguishing energy 76 embodied in a communication signal from energy 86 produced by movement of the magnet. For this reason the circuit 24, at least, constantly monitors the status of the links 60 and 62.

Other safeguards can be adopted to ensure the integrity and the liability of the distinguishing process.

A logic module 90 monitors a peak voltage 92 of the generated electrical energy. If the peak voltage is above a reference level and each link has been broken then it is taken that these happenings are indicative of a genuine shock tube event. A further degree of validation could be achieved by using a sensor 94 to detect a temperature change within the hollow interior 38. As the temperature change takes place at a relatively low rate energy generated by the movement of the magnet can be used to execute a validation process. Once a genuine shock tube event has been ascertained energy in the storage capacitors 26 is used to continue operation of the circuit 24. An extended timing interval, previously programmed in the field using the communication technique referred to, is executed by means of a suitable timer 96 included in the control circuit 24. At the end of the timing interval the initiating element 20 is fired, using energy from the capacitors 26.

The voltage which is produced in the coil by magnet movement is preferably higher than the voltage which is produced during a communication phase. This, in itself, is then used as a factor which enables magnet movement to be distinguished from a communication signal. Safety advantages may follow from this distinction—for example the communications voltage may be insufficient to drive the initiator but adequate for two-way communication purposes.

A communication signal can further be distinguished from a signal which is induced in the coil 32 by magnet movement by ensuring that the programming testing machine transmits a communication signal which is modulated or which is at a particular frequency which is clearly distinguishable from a frequency which might be produced by movement of the magnet.

The invention claimed is:

1. An electronic detonator comprising:

an explosive charge;

an initiating element which is exposed to the explosive charge;

a control circuit;

a housing at least partially surrounding the explosive charge, the initiating element, and the control circuit;

at least one coil having a plurality of windings arranged inside the housing in a tubular configuration, wherein the coil includes a first end, an opposed second end and a hollow interior between the first and second ends;

a magnet which is held at rest position that is displaced from the coil;

a passage which extends from the rest position to the first end of the coil, through the hollow interior to the second end of the coil and then to a remote position;

a shock tube connected to the housing;

at least one sensor to detect one or more characteristics which are uniquely associated with a genuine shock tube event;

a connector for connecting the shock tube to the housing with an end of the shock tube positioned proximate to the magnet at the rest position whereby the magnet is operable to move along the passage by the effect of a pressure wave produced upon ignition of the shock tube to produce electrical energy and at least part of said electrical energy is used to power the control circuit, wherein the control circuit associates said movement of the magnet with a genuine shock tube event only if during such movement or within a predetermined time period thereafter the at least one sensor detects one or more characteristics which are uniquely associated with a genuine shock tube event, wherein the at least one coil, upon detecting a communication signal, provides energy for operation of the control circuit during a communication phase and wherein the control circuit distinguishes energy produced in the at least one coil by movement of the magnet from energy produced in the at least one coil by a communication signal.

2. The electronic detonator according to claim 1, further comprising a retention mechanism for retaining the magnet at the rest position.

3. The electronic detonator according to claim 2 wherein the retention mechanism is selected from: a frangible membrane which holds the magnet in place, a ferromagnetic material located at the rest position, an adhesive and a combustible adhesive.

4. The electronic detonator according to claim 1 further comprising one or more seals to seal a gap between a surface of the magnet and an opposing surface of the passage.

5. The electronic detonator according to claim 1 further comprising a rebound mechanism at the remote position which absorbs kinetic energy from an impacting magnet and which then releases energy by causing the impacting magnet to move in an opposing direction.

6. The electronic detonator according to claim 1 wherein the at least one sensor is responsive to temperature.

7. The electronic detonator according to claim 1 further comprising at least one link which is exposed to the end of the shock tube and wherein the integrity of the link is monitored by means of the control circuit.

8. The electronic detonator according to claim 1 wherein the control circuit includes a communication module which is adapted to process a communication signal received by the at least one coil, and to use the at least one coil as a transmitting coil for the transmission of data.

9. The electronic detonator according to claim 8 wherein the electrical energy required to power the control circuit to enable communication signals to be received and to be send is transmitted at a frequency is less than 1 MHz.

* * * * *